US011189902B1

(12) United States Patent
Merhav et al.

(10) Patent No.: US 11,189,902 B1
(45) Date of Patent: Nov. 30, 2021

(54) METHOD AND APPARATUS FOR A MINIATURE BROADBAND RF POWER DIVIDER

(71) Applicants: Scientific Components Corporation, Brooklyn, NY (US); Elbit Systems EW and SIGINT—Elisra, Holon (IL)

(72) Inventors: Sahar Merhav, Brener Hill (IL); Amir Yerushalmy, Rishon (IL)

(73) Assignee: Scientific Components Corporation, Brooklyn, NY (US)

( * ) Notice: Subject to any disclaimer, the term of this patent is extended or adjusted under 35 U.S.C. 154(b) by 0 days.

(21) Appl. No.: 17/066,908

(22) Filed: Oct. 9, 2020

Related U.S. Application Data

(60) Provisional application No. 62/913,566, filed on Oct. 10, 2019.

(51) Int. Cl.
*H01P 5/18* (2006.01)
*H01P 1/22* (2006.01)
*H01P 5/12* (2006.01)

(52) U.S. Cl.
CPC ..... *H01P 5/18* (2013.01)

(58) Field of Classification Search
CPC ..... H01P 5/12; H01P 5/18; H01P 1/22
USPC ..... 333/100, 124, 81 R
See application file for complete search history.

(56) References Cited

U.S. PATENT DOCUMENTS 6,621,374 B2 * 9/2003 Higgins ..... H01P 5/16 330/295
6,751,489 B2 * 6/2004 Shen ..... H01P 1/2135 505/210
9,947,984 B2 * 4/2018 Vickes ..... H01P 5/16
2009/0295500 A1 * 12/2009 Ives ..... H01P 5/16 333/128

* cited by examiner

*Primary Examiner* — Dean O Takaoka
(74) *Attorney, Agent, or Firm* — Lawrence G. Fridman, Esq; Feigin & Fridman, LLC

(57) ABSTRACT

An apparatus and method for electrical power splitting with a reduced physical size by using reactive electrical components, producing an increase in signal isolation among output ports and a reduction in internal electrical losses, and operable over a large bandwidth extending from DC to microwave frequencies. Attenuators with capacitors in parallel are used inboard of each output port to achieve extended broadband operation. 2-way and N-way power splitters and corresponding power combiners are described.

14 Claims, 8 Drawing Sheets

METHOD AND APPARATUS FOR A MINIATURE BROADBAND RF POWER DIVIDER

CROSS-REFERENCE TO RELATED APPLICATION

The present application claims priority of Provisional Patent Application Ser. No. 62/913,566 filed by the Applicants on Oct. 10, 2019, the entire disclosure of this application is hereby incorporated by reference.

FIELD OF THE INVENTION

The present invention relates generally to surface mount electronic devices, and in particular to miniaturization of radio frequency (RF) power divider and RF power combiner devices.

BACKGROUND OF THE INVENTION

Radio frequency (RF) signal energy power divider and/or combiner devices that have broad bandwidths and may extend to low frequencies, e.g. zero hertz, are either very lossy, have low isolation and/or are large in physical size.

Referring to FIG. 5, devices constructed 500 according to Wilkinson [E. J. Wilkinson, "*An N-way Power Divider*", *IRE Trans. on Microwave Theory and Techniques*, vol. 8, p. 116-118, January 1960] are limited such that their lower frequency utility declines due to the large size of the required transmission lines 510 necessary to achieve performance at such low frequencies, e.g. below 500 megahertz (MHz). The size of such devices constructed according to Wilkinson where there is reliance on physically spatially distributed elements, e.g. transmission lines 510, with lengths proportional to useful signal wavelength, will increase as frequency decreases, according to the inverse relation of frequency and wavelength, in order to maintain utility.

Monolithic microwave integrated circuit (MMIC) power splitters that operate in a microwave frequency band of, for example, from 500 MHz or higher frequency lower band bound, generally use a Wilkinson theoretical style topology, where series-connected transmission lines are used to achieve the theoretical electrical properties. These types of splitters have increasing size with lower frequency band bounds. In many designs, such an increase in size prevents the device from practical manufacturing using known methods, e.g. on a MMIC substrate.

Referring to FIGS. 6*a* and 6*b*, other RF signal energy power divider devices 600, 620 may be constructed of three resistors 610, 630, connected in a delta 600 or wye 620 topological configuration. Such devices perform over large bandwidths, e.g. with lower frequency limits extending to zero hertz, but have inherent losses due to the use of series-connected resistors 610, 630, which dissipate significant RF signal power within the circuit. Further, an isolation between the output ports of such a divider device is limited due to the resistive connections providing cross-over signal paths, and is typically limited to no more than the loss experienced by an RF signal transiting such a device.

There remains a need for a device and technique to perform these functions using a smaller size, with high RF signal isolation among output ports and/or with less RF signal energy loss from input to output of a device.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
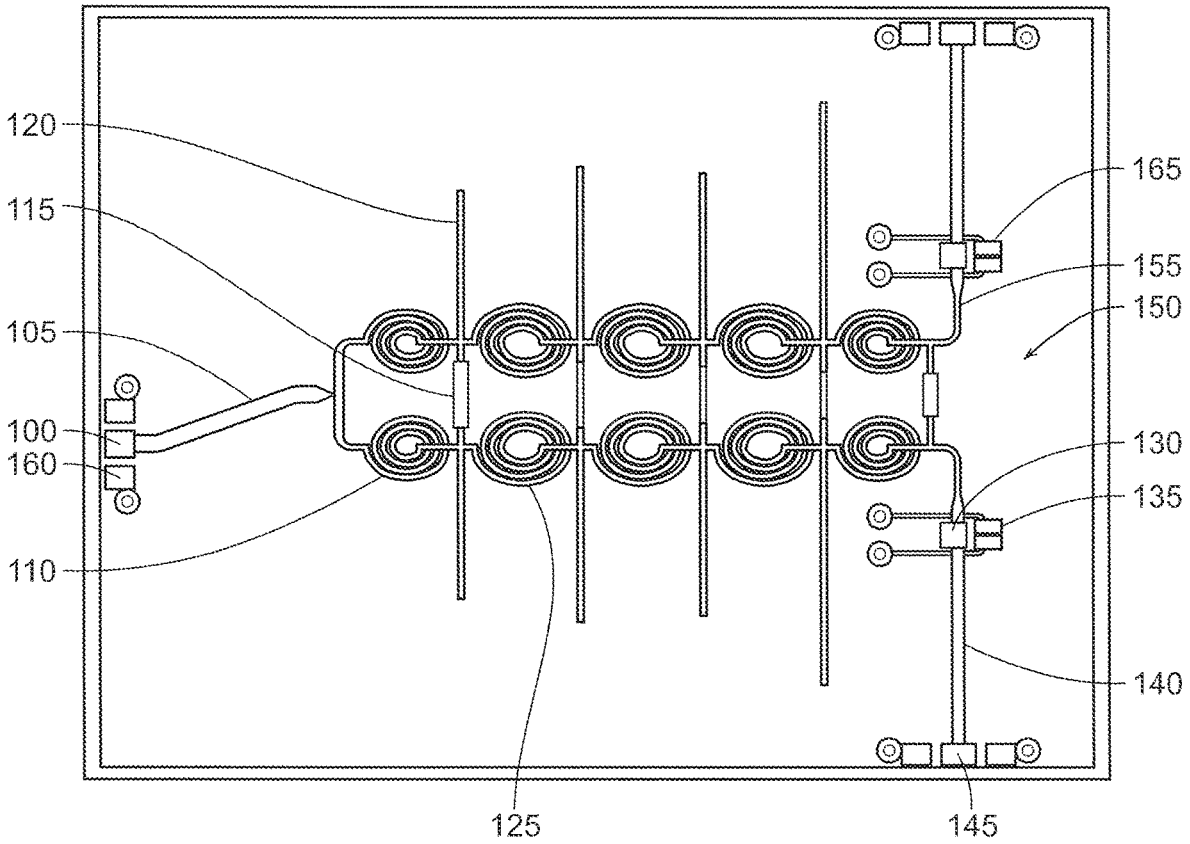
FIG. 1 depicts an exemplary diagram according to one embodiment of the present invention.

Embodiments of the invention are illustrated by way of example and not limitation in the figures of the accompanying drawings, in which like reference numerals indicate corresponding, analogous or similar elements. It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE EMBODIMENTS OF THE INVENTION

In the following detailed description, numerous specific details are set forth in order to provide a thorough understanding of the invention. However, it will be understood by those skilled in the art that the invention may be practiced without these specific details. In other instances, well-known methods, procedures, and components have not been described in detail so as not to obscure the invention.

According to embodiments of the invention, radio frequency (RF) devices for dividing input signal power and/or energy among a plurality of output ports are referred to as power dividers (PD). Such devices may be reciprocal such that they may receive input signal power and/or energy from a plurality of ports, now used as input ports, and combine such signal power and/or energy into one output port, referred to as an input port when used as a PD, and may be referred to as a power combiner (PC). Such reciprocal devices may be referred to as a PD, and it may be understood that a device is capable of operation as both a PD and a PC, according to its reciprocal nature and/or construction. A PD may also be referred to as a power splitter (PS).

A PS may be constructed by a variety of methods and by utilizing a selection of several materials, all with properties that work well with RF signals. Such signals may be in the microwave frequency range, e.g. 300 MHz to 300 GHz, and/or other higher frequencies, lower frequencies and/or any combination of such frequencies, and may be in a range extending from zero hertz, e.g. direct current (DC), through microwave frequencies, e.g. eight (8) gigahertz (GHz), eighteen (18) GHz, etc. Such materials may be selected such that a PS may be constructed in a monolithic microwave integrated circuit (MMIC) arrangement, topology and/or device. The construction of such devices in a MMIC arrangement may not limit its performance to only one or more microwave frequency ranges, but rather may serve to define materials used in a physical construction. Embodiments of the invention may use MMIC devices for frequency ranges other than and/or including microwave frequencies.

Connection within a PD are made by electrical connection to operably maintain electrical energy signal power flow through the device. Connection material may be by any suitable conductor material, e.g. a metallic electrical conductor. Materials may be homogeneous and/or heterogeneous, where such materials may be combined, coated or plated, etc.

Figure 7:
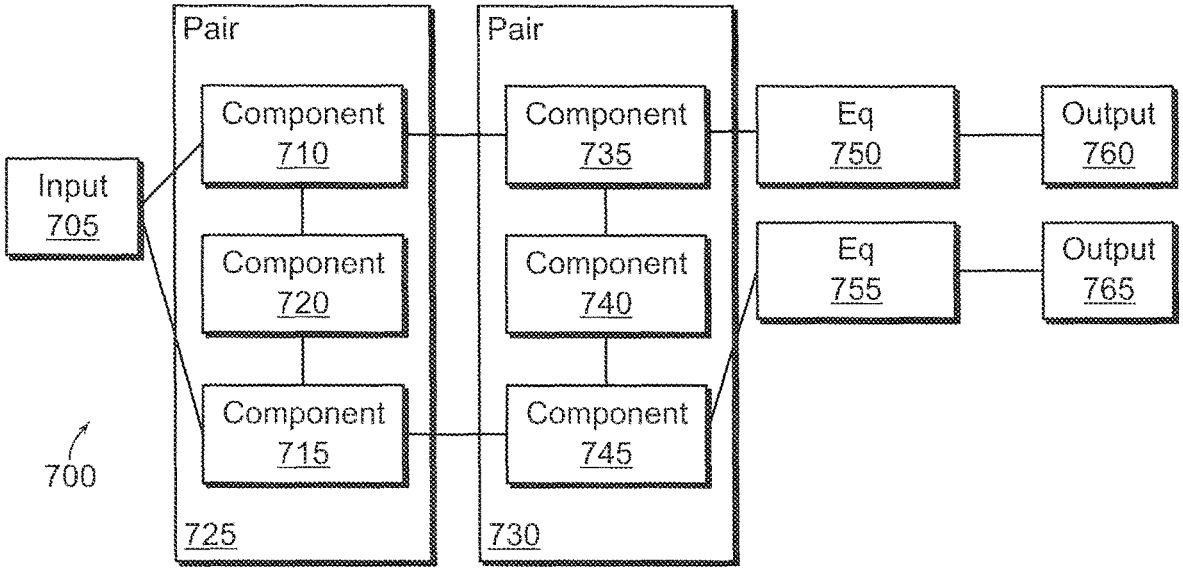
FIG. 7 depicts an exemplary block diagram according to embodiments of the present invention.

Embodiments of the invention 700 may be understood with reference to FIG. 7. Such embodiments may use a multi-section electrical signal power divider topology 725, 730, e.g. a multi-section Wilkinson style topology, where each output of a functional divider, output of 735 and output of 745 is connected to an input of a gain equalizer 750, 755. An output of a gain equalizer 750, 755 is connected to a device output port 760, 765. Such a multi-section topology may allow wideband high isolation to be present between output ports 760, 765, while gain equalizers 750, 755 may compensate for high signal power loss, for example at higher operational frequencies, e.g. 8 GHz, 18 GHz etc.

A gain equalizer 750, 755 may consist of, for example, a resistive pi-network with a shunt capacitor, e.g. connected across a series connected resistor element. A shunt capacitor may present an electrical open circuit voltage at DC, e.g. zero hertz, and a resistive pi-network may act like an RF signal power attenuator. As a frequency may increase, a capacitive reactance may decrease, such that at a high frequency a capacitor may act as an electrical short circuit voltage. Such a power splitter, at higher frequencies then may act as a traditional Wilkinson power splitter in that it would exhibit all of the inherent benefits of such a theoretical design.

In some embodiments, spiral inductors and/or in conjunction with shunt-connected open circuit planar capacitive transmission lines are introduced instead of traditional series-connected transmission lines, which allow for a significant reduction in overall size. Such a reduction may be due to shunt connected components not forcing series connected circuit components and/or elements to be spatially separated by a geometric length and/or size of such series connected circuit components. By using small elements, e.g. spiral inductors, only as series connected elements, and using spatial length transmission lines only as shunt components to create the electrical effect of theoretical power division, such a power splitter may achieve a significant reduction in overall size and/or footprint. Thus, its small size may allow it to be produced on a cost-effective wafer.

Embodiments of the invention may be a two-way electrical signal power splitter and may have an operating frequency band, e.g. of DC to 8.0 GHz, over all of which it may have a high isolation, e.g. 16 decibels (dB) at DC, and may become higher, e.g. 25 dB, at one or more frequencies within a band.

Other embodiments may be where a device may be constructed in chip form. Such a chip may be in a packaged form, e.g. a plastic or other encapsulation. The electrical properties necessary for proper functioning of the device may be fully contained on a chip, a monolithic chip or a chip with some embedded elements and some elements attached via post chip construction processes, e.g. wire bonding, etc. A variety of materials and/or manufacturing methods may be used to construct embodiments of the invention, and may be referred to collectively as a chip or in chip form. Selection of any particular materials, methods and/or processes will not limit the scope of the invention. An embodiment constructed as a chip may be complete or may be further placed into additional packaging, for example, to facilitate use in a variety of application environments and/or to provide additional protection from elements of an application environment, e.g. environmental moisture, solder reflow, etc. Such packaging may fully encapsulate such chip, and together a chip and its associated packaging may be a further embodiment of the invention. Packaging may be any of a variety of materials, e.g. plastics, ceramics, etc. Elements of a package may contain provisions for electrical connection of inputs, outputs, signal grounds, etc. to be delivered into and/or out of such a package without detriment to an electrical performance of a chip within a package. Additional package provisions may be provided for separation of input signals, output signals, electrical ground and the like.

Embodiments of the invention may be used to design a four-way electrical signal power splitter, e.g. a power splitter with one input and four outputs, providing for an input power to be divided among four individual output ports. Other embodiments may have one input and a plurality of output ports, provided power division occurs among two or more output ports. Power division may be equal among output ports or may be in another proportion among output ports, such that a total power delivered from all output ports, added to any internal circuit losses, equals a total power received by an input port. An exemplary embodiment may be a four-way equal power divider that may operate over a frequency band, e.g. at least DC to 18.0 GHz, and may have a high port-to-port isolation among all output ports, e.g. at least 13 dB and as high as 35 dB at some frequencies within an operating band, while having a low insertion loss, e.g. less than 6.5 dB. An insertion loss may be a loss of energy or power experienced by an electrical power signal transitioning a device from an input port to an output port and may represent internal circuit losses. An insertion loss may represent electrical energy that may be converted, for example, to heat within a circuit and/or circuit element of a circuit. An insertion loss may quantify electrical energy or power lost by components, topology, etc., of a circuit, where such energy may not be available for output by a circuit once the circuit is transitioned by such electrical signals. Electrical signals may be power signals, voltage signals, current signals, etc.

In some embodiments an electrical impedance may be an electrical signal resistance of alternating current (AC) signals and their associated electrical signal energies transitioning an electrical conductor. Electrical impedance across a transition among electrical conductors, electrical devices, electrical circuits and/or combinations of the like, is constant when the electrical impedance of each conductor, device, circuit and/or combination is substantially the same. When an electrical impedance differs, a mismatch is created. Such a mismatch may have a characteristic of an increase in reflected electrical energy. Such a mismatch may be characterized by a reduction in electrical energy being delivered into or out of a conductor, device, circuit and/or combination. Electrical impedance may vary with varying frequencies of AC signals, and may be considered to be frequency dependent.

FIG. 7 is a depiction of an exemplary embodiment of the invention. A power divider 700 may have an input port 705. An input port may be used to facilitate connection of an external source of an electrical signal to a device. An input port may be comprised of a center conductor and one or more ground conductors. An input conductor and associated one or more ground conductors may be arranged in a variety of configurations, e.g. coaxial, planar, microstrip, stripline, or any other suitable configuration for delivering an electrical signal power into a device. An external connection to an input port may be exposed to an external environment and may be constructed to be compatible with a manufacturing process, e.g. wire bond, solder, etc. An internal connection of an input port may be exposed to an external environment or may be protected from an external environment, e.g. located within a plastic encapsulation. A characteristic impedance of an input port may be equivalent to a characteristic impedance of a circuit to which the device may be connected, such that signal reflections between the device and an external circuit may be minimized.

An input port 705 may be connected to a pair 725 of reactive circuit elements and/or components. Such a connection may be by a planar or other conductor, and such conductor may have an impedance such that electrical signal reflections among input port 705 and reactive circuit element pair 725 are minimized. For example, an impedance of a connection conductor may be ($Z*\sqrt{2}$), where Z is a characteristic impedance of input port 705. A pair of reactive circuit elements may be comprised of a component 710 for one arm of a divider and another component 715 for another arm of a divider. When equal power division is performed, component 710 is the same as component 715, creating a symmetrical topology. A component 710 in one arm may be electrically connected to a component 715 in another arm by a resistive device 720, e.g. a resistor. Resistor 720 may be a planar printed resistor or any other suitable resistive device. A value of resistor 720 may be selected to maintain a specific impedance of a circuit while providing for a dissipation path of any electrical signal energy that may be unbalanced between component 710 and component 715, and may contribute to an isolation of a circuit. For example, resistor 720 may be ($2*Z$), where Z is a characteristic impedance of input port 705.

Component 710 may be comprised of one or more reactive circuit elements, reactive circuit element may be an inductor, a capacitor, an open-circuit transmission line, a short-circuit transmission line, or any other circuit element behaving as a reactive element over an operational frequency band. Series connected circuit elements within component 710 may be selected to be lumped elements or planar constructions of lumped elements. For example, an embodiment may have an inductor, e.g. a planar spiral inductor, as a series connected element. By using lumped series connected elements, an input to such an element can be spatially close to an output of the element, facilitating a reduction in size of the overall device. Such a reduction in size is compared to using a distributed series-connected element, e.g. a planar transmission that must have series dimensions proportional to a wavelength of an applied electrical signal. A significant size reduction benefit may then be realized when an embodiment of the invention is used for electrical signals with operational frequency bands extending to low frequencies, e.g. frequencies below 500 MHz, frequencies approaching/extending to DC, etc.

Reactive circuit elements within component 710 may be used in combination, e.g. as a resonator. For example, a series connected planar spiral inductor may be used with a planar printed open circuit transmission line stub configured with a predetermined capacitance. Such a stub may be positioned to be in shunt with the series electrical signal propagation path, and may located at an output of an inductor. In some embodiments a combination of a series connected spiral inductor and a capacitive stub at the output of the inductor may have an equivalent calculated impedance to a theoretical series-connected wavelength-proportional transmission line, and such an impedance may retain its equivalence over an operating frequency band. Thus, embodiments of the invention may use a series spiral inductor in combination with a shunt capacitive stub to realize a reduction in size of a circuit, since the series size of such a circuit may not be proportional to an applied electrical signal frequency or bandwidth.

Component 715 may be comprised of reactive circuit elements, and such circuit elements may be a same type, construction, arrangement, configuration, selection, etc. of corresponding circuit elements within component 710. In an embodiment where equal power division among outputs is created, a size, value, etc., of circuit elements of component 715 are equivalent to circuit elements of component 710.

A broad operational frequency band, e.g. an operational frequency band greater than 10% around a center frequency, an operational frequency band with greater than an octave bandwidth, etc., may be achieved by using more than one pair 725 of reactive circuit elements and/or components in cascade. Embodiments may have a plurality of pairs of reactive circuit elements in cascade. An exemplary second pair 730 of reactive circuit elements in cascade is depicted in FIG. 7. Any number of additional pairs of reactive circuit elements may be added in cascade subsequent to a first pair 725. A number of pairs, or stages, in cascade may be proportional to an operational frequency bandwidth, where increasing a number of stages provides for operation over a larger bandwidth. For example, three stages in cascade may provide for operation over a decade bandwidth. An increase in a number of stages may provide an improved performance, for example, by a reduction in a peak-to-peak amplitude variation over an operational frequency band, or a sub-band. Reactive circuit element pair 730 may be comprised of component 735 series connected with component 710, component 745 series connected with component 715, and component 740 connected between an output of component 735 and an output of component 745. Component 735 may be comprised of reactive circuit elements, and such circuit elements may be a same type, construction, arrangement, configuration, selection, etc. of corresponding circuit elements within component 710. Component 745 may be comprised of reactive circuit elements, and such circuit elements may be a same type, construction, arrangement, configuration, selection, etc. of corresponding circuit elements within component 715. Component 740 may be comprised of resistive circuit elements, and such circuit elements may be a same type, construction, arrangement, configuration, selection, etc. of corresponding circuit elements within component 720. In an embodiment where equal power division among outputs is created, a size, value, etc., of circuit elements of component 735 are equivalent to circuit elements of component 745. Values of circuit elements of component 735 may be equivalent to values of circuit elements of component 710, or may be of different values, and likewise for component 745 and component 715, according to an embodiment.

An output of component 735 may be electrically connected to an input to equalizer 750. Such a connection may be by a planar or other conductor, and such conductor may have an impedance such that electrical signal reflections among component 735 and equalizer 750 are minimized. A transformer planar conductor, or other impedance matching device, may be used for such an electrical connection.

Equalizer 750 may be comprised of a resistive attenuator, where at least three resistive elements, e.g. planar printed resistors, are configured into a pi or wye configuration. Such resistors may have predetermined values to create an input impedance and an output impedance of equalizer 750 where signal reflections at an input and at an output of equalizer 750 are minimized. Equalizer 750 also comprises a capacitive element, e.g. a planar gap capacitor, a lumped element surface-mount capacitor, etc., connected in parallel with the series connected resistive elements of equalizer 750. For example, a pi resistor configuration may have one series resistor connected from input to output, a shunt resistor connected from an input to ground, a shunt resistor connected from an output to ground and a capacitor connected in parallel to the series resistor from input to output. A value of a capacitor is selected to provide operation of equalizer 750 over a full operational electrical signal bandwidth, including where its electrical properties may behave differently at different frequencies.

An output of equalizer 750 is electrically connected to output port 760. Such a connection may be by a planar or other conductor, and such conductor may have an impedance such that electrical signal reflections among equalizer 750 and output port 760 are minimized. Output port 760 may have a same construction and/or properties of input port 705.

Equalizer 755 may be connected to component 745 in a same manner as equalizer 750 is connected to component 735. Equalizer 755 may be constructed in a same manner as equalizer 750. In an embodiment where equal power division among outputs is created, a size, value, etc., of circuit elements of equalizer 755 are equivalent to circuit elements of equalizer 750. Equalizer 755 may be connected to output port 765 in a same manner as equalizer 750 is connected to output port 760.

An exemplary embodiment of a power divider chip is depicted by FIG. 1. A circuit is constructed on substrate 150. Such a construction may be referred to as a MMIC device, a planar construction, microstrip construction, or other suitable descriptions. An input port is comprised of center conductor 100 and ground connections 160, for example depicted as symmetrical planar ground connections. Input port center conductor 100 is connected to a first pair of reactive circuit elements by planar transmission line 105. A first pair of reactive circuit elements is comprised of spiral inductor 110, shunt capacitive stub 120, and their corresponding elements to create a pair, and planar printed resistor 115. Spiral inductor 125 is an element of a second reactive circuit stage pair. Such an exemplary embodiment is comprised of five stages of reactive circuit element pairs in cascade, each with their associated connecting resistor. An output of a final cascade stage is connected to equalizer 165 by impedance transformer planar transmission line 155. Equalizer 165 is comprised of resistors 130 and capacitor 135. Equalizer 165 is connected to output port 145 by planar transmission line 140. A substrate 150 may be any of a variety of suitable materials for use in an RF and/or microwave circuit, e.g. ceramic, alumina, aluminum nitride, silicon, polytetrafluoroethylene (PTFE), fiberglass, etc.

Other features may be present on or within a power divider chip depicted by FIG. 1, for example, a resistive element from an input port or an output port to ground, e.g. for protection from electrostatic discharge (ESD) damage, RF or other shields, attachment features, features for compatibility with a package, features for compatibility with an assembly or post-assembly process, etc. Some additional features may be metallic plated holes that extend from a top surface to a bottom surface of substrate 150, e.g. plated-thru holes, and may be air-cavity holes with surface metallic plating, filled metallic holes, or a combination of both. Such holes may interact with, or be electrically connected to, a ground plane and/or ground connection. Such a ground connection may be internal to a power divider circuit of FIG. 1, may be external to a power divider circuit of FIG. 1, or both.

Figure 2:
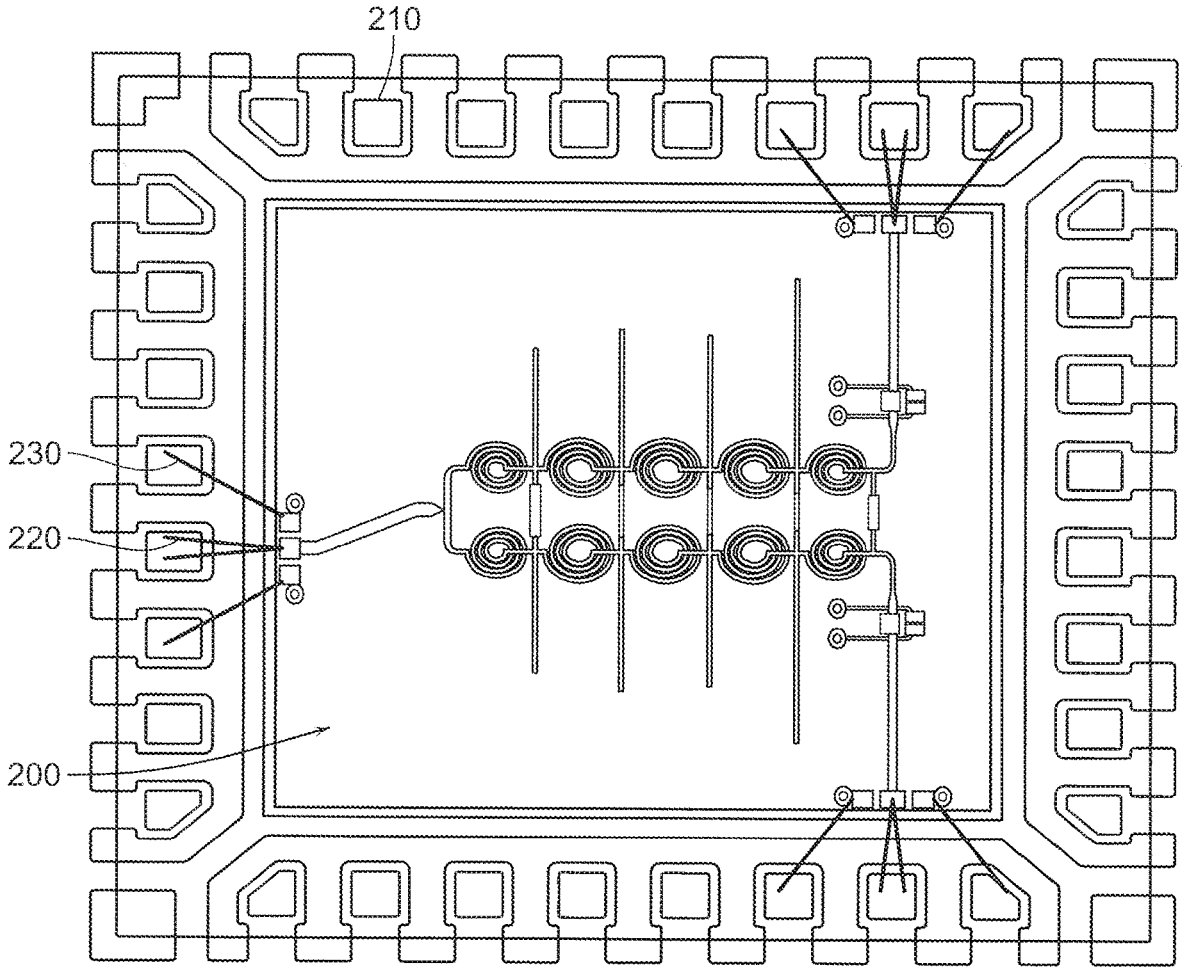
FIG. 2 depicts an exemplary diagram according to another embodiment of the present invention.

An exemplary embodiment of a power divider chip in a protective package is depicted by FIG. 2. Power divider chip 200 is attached to the interior of package 210. Attachment may be, for example, by epoxy, eutectic attachment, etc. Input port center conductor 220 is electrically attached, e.g. via wire bonding, to a conductive connection extending to the exterior of package 210. Ground connection 230 of an input port is electrically attached, e.g. via wire bonding, to a conductive connection extending to the exterior of package 210. Similar connections are made for output ports. Additional features, e.g. ESD protection, RF shielding, process and/or assembly compatibility features, etc., may also be included within and/or as a part of such a package 210.

Figure 3:
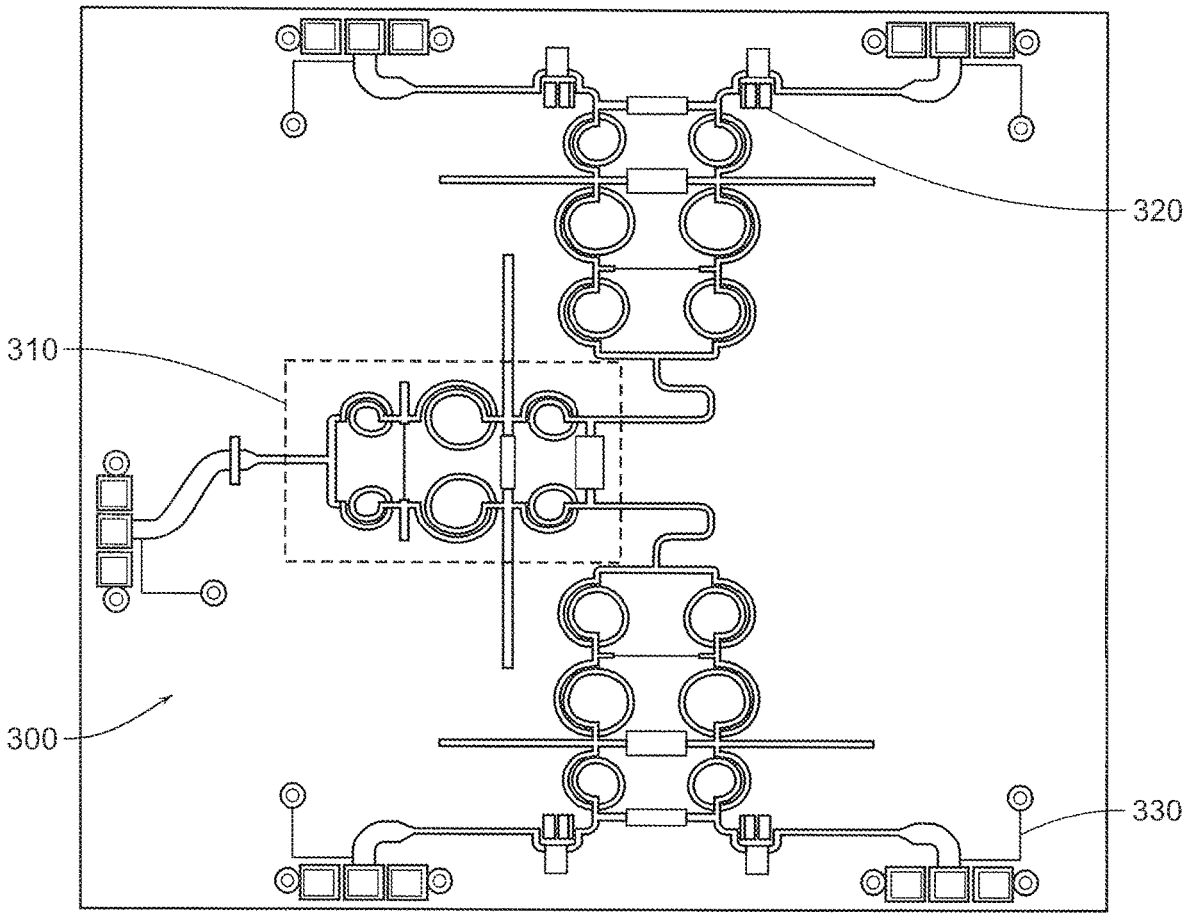
FIG. 3 depicts an exemplary diagram according to a further embodiment of the present invention.

An exemplary embodiment of a power divider chip with four outputs is depicted by FIG. 3. A circuit is constructed on substrate 300. Power divider circuit 310 is a three-stage cascade exemplary embodiment, otherwise similar to an exemplary power divider of FIG. 1, excluding equalizers. Power divider circuit 310 is created in three locations on the circuit of FIG. 3, one connected to an input port, a second connected with its input connected to an output of one arm of the first one, and a third one connected with its input connected to the other output of the first one. The four outputs of the second and third power dividers, two outputs from each of the second and the third power dividers, may be connected each to an input of an equalizer. An output of each equalizer may be connected to an output port.

An exemplary embodiment depicted by FIG. 3 is a shunt resistive element 330 connected from a port, input and/or output port, to ground. Such a resistive element may be of a high impedance, for example relative to a characteristic impedance, and may provide protection from undesired external electrical stimulus, e.g. electrostatic discharge (ESD). Such resistive elements may be created in a similar manner as other resistive elements of the circuit. A length of such a resistive element 330 may be predetermined, may depend on an operational frequency band and/or range, or may be determined by other analytical or empirical methods.

Figure 4:
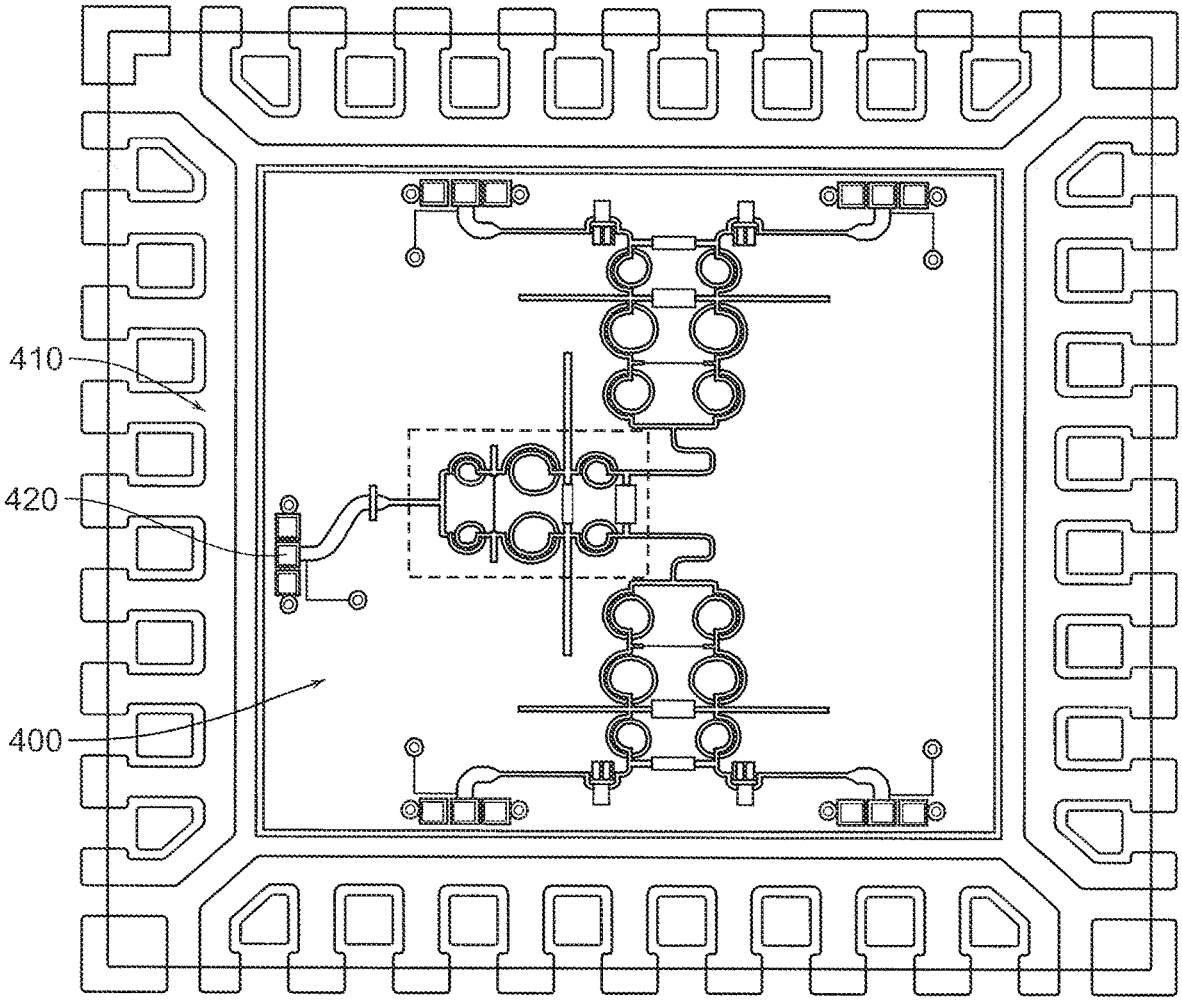
FIG. 4 depicts an exemplary diagram according to still another embodiment of the present invention.
Figure 5:
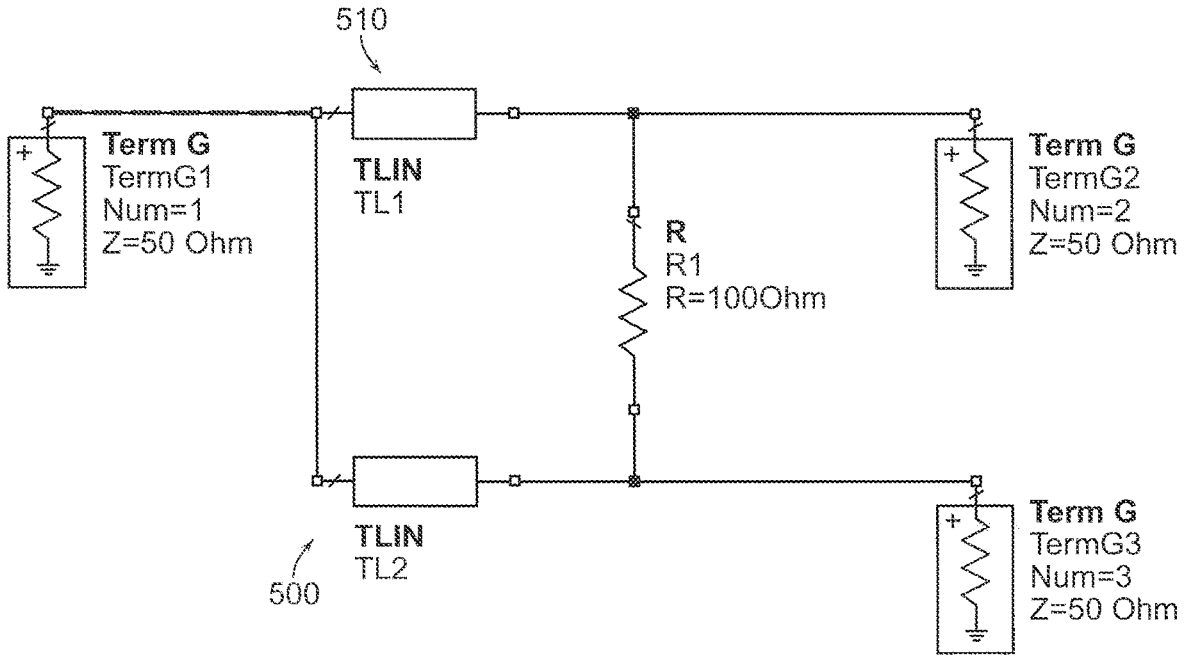
FIG. 5 depicts an exemplary diagram according to a theoretical device.
Figure 6A:
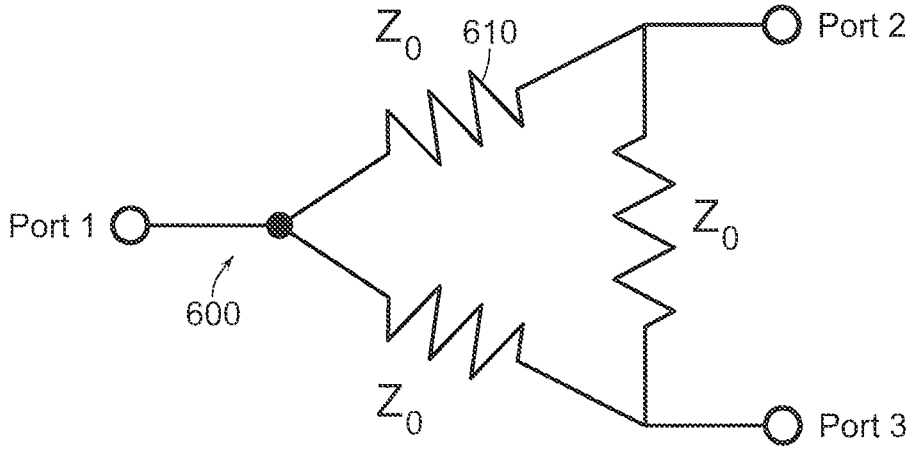
FIGS. 6*a*, 6*b* each depict an exemplary diagram according to a theoretical device.
Figure 6B:
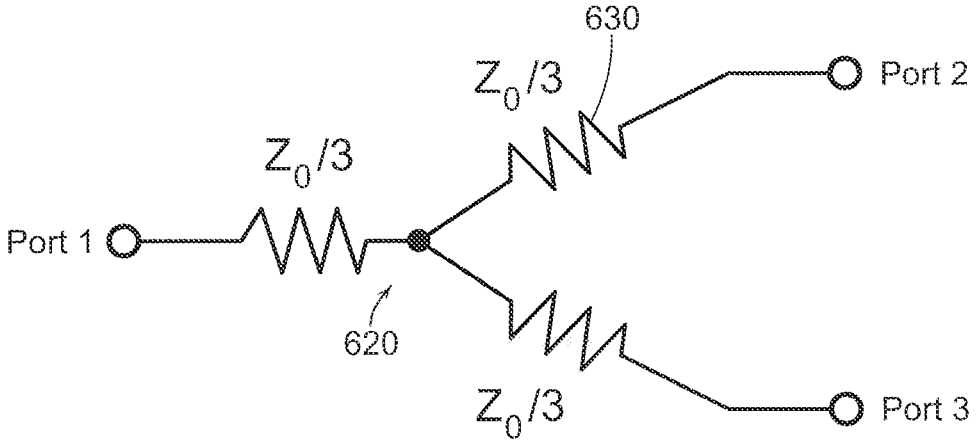

An exemplary embodiment of a power divider chip with four outputs in a protective package is depicted by FIG. 4. Power divider chip 400 is attached to the interior of package 410. Attachment may be, for example, by epoxy, eutectic attachment, etc. Input port center conductor 420 is electrically attached, e.g. via wire bonding, to a conductive connection extending to the exterior of package 410. Other connections, e.g. ground connections, output port connections, etc. are also made, although not fully depicted.

Figure 8:
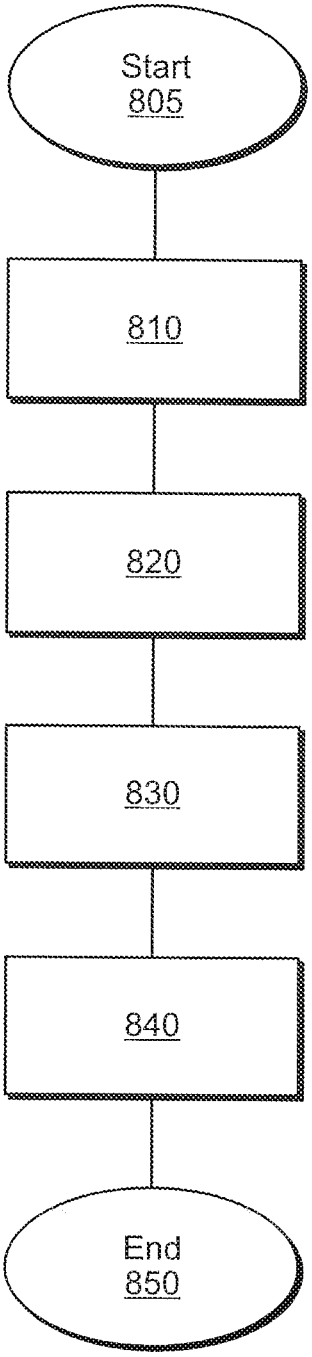
FIG. 8 depicts an exemplary block diagram according to the method of the present invention.

An exemplary method embodiment is depicted by FIG. 8. A process to create a power divider according to embodiments of the invention is started 805. An operational bandwidth is considered, along with other performance considerations, e.g. peak-to-peak amplitude flatness, overall external return loss and/or input and/or output voltage standing wave ratio (VSWR), etc., are considered, and may be included in design decisions. Using such considerations, a number of sections of a power divider is determined 810. Then values and features of elements of each power divider section, e.g. spiral inductor size and/or electrical properties, open-circuited shunt capacitive stub geometrical dimensions and/or electrical properties, printed resistor geometrical dimensions and/or electrical properties, planar microstrip transmission line connections among elements for electrical connection and/or matching to reduce reflective electrical signal energy, etc., are determined and created 820, for example on a microstrip substrate. Attenuators for broadband matching and electrical operation are created 830 for connection at the output of each power divider section. Optionally, a power divider created according to embodiments of the invention may be assembled 840 into a package, e.g. a plastic protective package, and associated electrical connections for transmission of electrical signal energy into and/or out of such a power divider may be made. Additional features, e.g. resistive ESD protection, etc., may also be designed and included. A process may end 850 after a completed device is created.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

What is claimed is:

1. An apparatus for electrical power splitting comprising:

a first port operably as an input port;

a first and a second reactive circuit component selected as a pair, whereas the input of each of said reactive circuit components are electrically connected to each other and electrically connected to said first port, and whereas the output of each of said reactive circuit components are electrically connected to opposing ends of a resistor;

a first and a second attenuator selected as a pair, each comprising a plurality of resistive circuit components, whereas one or more are connected in series with electrical signal power flow and one or more are connected in shunt to electrical signal power flow, and a reactive circuit component, whereas said reactive circuit component is electrically connected in parallel with said one or more series connected resistive circuit components, the input of said first attenuator electrically connected to the output of said first reactive circuit component, and the input of said second attenuator electrically connected to the output of said second reactive circuit component;

a second port operably as an output port, said second port electrically connected to the output of said first attenuator; and a third port operably as an output port, said third port electrically connected to the output of said second attenuator.

2. The apparatus of claim 1, wherein said first port receives an input electrical signal power, said second port and said third port each deliver an output electrical signal power less than said input electrical signal power such that the sum of each of said output power equals the said input power, less any internal circuit losses.

3. The apparatus of claim 2, wherein said first and second reactive circuit components are selected to produce an electrical signal power output at said second port equal in power to an electrical signal power output at said third port.

4. The apparatus of claim 2, wherein said first and second reactive circuit components are each comprised of an inductor and a capacitor.

5. The apparatus of claim 4, wherein said inductor is a planar spiral inductor.

6. The apparatus of claim 4, wherein said capacitor is a planar open-circuit stub.

7. The apparatus of claim 4, wherein said inductor and said capacitor are selected to have electrical properties with an equivalency to a transmission line proportional in length to the wavelength of said input electrical signal.

8. The apparatus of claim 1, further comprising a second pair of third and fourth reactive circuit components, the input of said third reactive circuit component electrically connected to the output of said first reactive circuit component, the input of said fourth reactive circuit component electrically connected to the output of said second reactive circuit component, the output of said third reactive circuit component electrically connected to a first end of a second resistor, the output of said fourth reactive circuit component electrically connected to a second end of said second resistor, the input of said first attenuator electrically connected instead to the output of the third reactive circuit component, and the input of said second attenuator electrically connected instead to the output of the fourth reactive circuit component.

9. The apparatus of claim 8, wherein said second pair and said second resistor further comprise a plurality of pairs of reactive circuit components and resistors, each electrically connected in succession with the input of each said reactive circuit component connected to the output of a previous said reactive circuit component, the output of each said reactive circuit component connected to opposing ends of said resistor, the output of the final odd-numbered reactive circuit component electrically connected to the input of said first attenuator and the output of the final even-numbered reactive circuit component electrically connected to the input of said second attenuator.

10. The apparatus of claim 9, wherein said electrical power comprises radio frequency alternating current signal energy extending from zero hertz to eight gigahertz, inclusive.

11. The apparatus of claim 9, wherein said electrical power comprises radio frequency alternating current signal energy extending from zero hertz to eighteen gigahertz, inclusive.

12. The apparatus of claim 9, wherein electrical signal isolation between said second port and said third port is greater than twice the loss incurred by said electrical power transiting either from said first port to said second port or from said first port to said third port.

13. The apparatus of claim 1, wherein said electrical connections are planar and each are constructed with geometric dimensions such that reflection from forward to reverse direction of electrical signal power among each said electrically connected components is minimized.

14. The apparatus of claim 1, wherein said second port and said third port are operably each input ports and said first port is operably an output port, whereas electrical signal power input to said second port is combined with electrical signal power input to said third port, and said combined electrical signal power is output from said first port to perform the function of a power combiner.

* * * * *